US007074110B1

(12) United States Patent
Wolf

(10) Patent No.: US 7,074,110 B1
(45) Date of Patent: Jul. 11, 2006

(54) OPTICAL COUPLER HUB FOR CHEMICAL-MECHANICAL-PLANARIZATION POLISHING PADS WITH AN INTEGRATED OPTICAL WAVEGUIDE

(76) Inventor: Stephan H Wolf, 1649 17th St., Los Osos, CA (US) 93402

( * ) Notice: Subject to any disclaimer, the term of this patent is extended or adjusted under 35 U.S.C. 154(b) by 248 days.

(21) Appl. No.: 10/688,482

(22) Filed: Oct. 18, 2003

Related U.S. Application Data

(63) Continuation-in-part of application No. 09/991,122, filed on Nov. 23, 2001, now Pat. No. 6,780,085, and a continuation-in-part of application No. 10/118,755, filed on Apr. 8, 2002, now abandoned, and a continuation-in-part of application No. PCT/US02/37761, filed on Nov. 22, 2002.

(51) Int. Cl.
*B24B 49/12* (2006.01)

(52) U.S. Cl. ..... 451/6; 451/288

(58) Field of Classification Search ..... 451/6, 451/5, 288, 287, 41
See application file for complete search history.

(56) References Cited

U.S. PATENT DOCUMENTS 5,838,447 A 11/1998 Hiyama et al.
5,913,713 A 6/1999 Cheek et al.
5,949,927 A 9/1999 Tang
5,964,643 A 10/1999 Birang et al.
6,012,967 A 1/2000 Satake et al.
6,106,662 A 8/2000 Bibby, Jr. et al.
6,146,242 A 11/2000 Treur et al.
6,190,234 B1 2/2001 Swedek et al.
6,261,151 B1 7/2001 Sandhu et al.
6,395,130 B1 5/2002 Adams et al.
6,485,354 B1 11/2002 Wolf
6,676,482 B1 * 1/2004 Bibby et al. ..... 451/6

* cited by examiner

*Primary Examiner*—Robert A. Rose
(74) *Attorney, Agent, or Firm*—William Keyworth; Bill & Mary Lou Inc.

(57) ABSTRACT

An apparatus is disclosed which improves the optical monitoring of semi-conductor wafers undergoing chemical mechanical planarization (CMP). The apparatus consists of two assemblies. The first is a fiber optical wave-guide assembly installed within the polishing pad during the pad's construction. This assembly forms an integrated optical waveguide originating from the center of rotation of the polishing pad and terminating at a location within the wafer track. The second is a vacuum-attached hub containing optical and electronic devices, which couples light into the waveguide integrated into the polishing pad, provides light coupling to the center of rotation of the polishing pad, provides means for converting the received light into a signal that is transmitted to the CMP tool control system, and also has provision to prevent polishing slurry from coming in contact with the optical and electronic components. Alternately the vacuum-attached hub may contain optical devices only, which couples light into the waveguide integrated into the polishing pad and transmits the received light to the CMP tool control system.

18 Claims, 7 Drawing Sheets

OPTICAL COUPLER HUB FOR CHEMICAL-MECHANICAL-PLANARIZATION POLISHING PADS WITH AN INTEGRATED OPTICAL WAVEGUIDE

CROSS-REFERENCE TO RELATED APPLICATIONS

This application is a continuation-in-part of U.S. application Ser. No. 09/991,122, "Fiber Optical Waveguide Embedded into the Polishing Pad for In-situ, Real-Time Monitoring of Thin Films During the Chemical Mechanical Planarization Process" filed on Nov. 23, 2001, now U.S. Pat. No. 6,780,085 that is incorporated by reference, and also a continuation-in-part of PCT application PCT/US02/37761, "Fiber Optical Waveguide Embedded into a Polishing Pad" filed on Nov. 22, 2002 that is incorporated by reference now abandoned.

This application is also a continuation-in-part of U.S. application Ser. No. 10/118,755, "Optical Coupler Hub for Chemical-Mechanical-Planarization Polishing Pads with an Integrated Optical Waveguide" filed on Apr. 8, 2002 that is incorporated by reference now abandoned.

STATEMENT REGARDING FEDERALLY SPONSORED RESEARCH AND DEVELOPMENT

Not Applicable.

REFERENCE TO A MICROFICHE APPENDIX

Not Applicable.

BACKGROUND OF THE INVENTION

Chemical-mechanical planarization (hereafter CMP) is a process employed in the fabrication of semiconductors. Silicon wafer substrates containing hundreds of semiconductor devices are brought into contact with a rotating planarization table covered by a polishing pad. Chemicals are added to accelerate and enhance the planarization of the wafer.

The CMP process can be separated into two major categories:

The material transition process involving the complete removal of a material, such as tungsten or copper, from the surface of the wafer until the underlying material layer is exposed, The film thinning process involving the removal of material, such as SIO2 or silicon, until a predetermined thickness remains.

Optical end pointing is one method of monitoring the reflectivity of the wafer surface during planarization and controlling the CMP process based on changes in said reflectivity. Both CMP categories can be successfully monitored with the use of monochromatic light. However, monochromatic light does not allow instantaneous film thickness measurement for the film thinning process. Endpoint systems using monochromatic light can only infer the amount of film removed during the process by monitoring the process over time, compiling several measurements, and subtracting a known beginning thickness. Endpoint systems using broadband light analyze several wavelengths of the reflectance simultaneously, and can thus measure the instantaneous film thickness directly.

In either case, the key to accurately measuring the wafer surface reflectivity is to position an optical sensor in such a way as to receive a noise-free signal. Sources of noise include thermal variations associated with the CMP process, electro-magnetic interference (EMI), light absorption, lens fogging, electrical slip-ring resistance fluctuations, and air bubbles.

In the case where the sensor is an electronic device, EMI, thermal, and slip-ring noise pose problems. Typically, polishing tables are driven by large variable-speed electric motors, which emit strong electro-magnetic fields of various frequencies. Any electrical conductor transitioning these fields will be subject to induced noise.

Opto electronic devices brought into contact with the CMP process are subject to the thermal fluctuations of the process. Polishing pad friction and exothermic chemical reactions create wide temperature changes. Optical responsivity, Johnson noise, and shot noise all increase as a function of temperature. Therefore, opto-electronic devices in contact with the CMP process typically need to be temperature stabilized before their output is a true measure of the incident radiation. Also, polishing pads are manufactured using heat and pressure. In some cases manufacturing temperatures can exceed the maximum temperature rating specified in the data sheets of the device. Exceeding this rating shortens their life span, or even causes immediate malfunction.

Electrical slip rings used to couple signals from the rotating table are very sensitive to the corrosive CMP chemicals and their vapors. They wear quickly in this environment and begin to suffer from intermittent variations in their contact resistance, which results in random sensor noise. Mercury wetted slip rings are less susceptible this problem, but they are typically limited to operating temperature below 70 degrees Celsius.

Optical sensors installed into the polishing table rely upon a transparent window glued into a hole punched completely through the polishing pad. This arrangement also suffers from optical noise problems, because the pad window tends to leak and thereafter forms a layer of condensate on its under side. Light passing through the condensate layer is scattered, which results in unreliable sensor performance. This particular problem is also temperature related, and can produce indeterminate effects on the optical signal integrity.

CMP processes rely heavily upon liquid chemicals known as slurry, which are not equally translucent to all wavelengths of light. The pad window will carry a layer of slurry along as it transitions under the wafer. As the thickness of this slurry layer increases, more of the light is lost due to absorption and scattering. The thickness of the slurry layer is affected by the position of the pad window with respect to the center of the wafer. For CMP tools whose spindles oscillate and rotate during processing, the slurry layer trapped between the pad window and the wafer will vary as the spindle traverses from side to side. It is theorized that this effect is caused by the difference in relative velocity between the wafer and the polishing pad. At one extreme in the spindle's stroke the wafer is rotating in the same direction as the polishing pad, and at the other extreme the wafer is rotating in the opposite direction. As the relative velocity between wafer surface and pad increases, the slurry layer between pad window and wafer shrinks as the wafer is sucked towards the pad, and the pad window deflects upwards in response to the suction. The result is a periodic disturbance in the optical signal, whose frequency is equivalent to the spindle oscillation frequency, and whose strength is a function of slurry translucence, wafer diameter, table speed, spindle speed, and spindle oscillation stoke.

Air bubbles can produce temporary lens-like occlusions at the pad window and diffract the light in unexpected directions. Even seemingly small bubbles trapped along the fringes of the window can pose a problem when they are sandwiched between the wafer and window lens. The creation of these bubbles increases with table speed and may be due to air being sucked out from the cavity beneath leaking pad windows.

Low-pass filtering is commonly used to attenuate the noise. In most cases, frequency components of the reflectance signals are low compared to those for the noise. Sometimes high order, low cut-off frequency low pass filtering are necessary to adequately attenuate the noise. Material transition processes often exhibit rapid changes in reflectivity at the instant of break through. Using such filtering introduces a significant phase shift in the observed reflectance signal, which causes the endpoint control system to lag behind the process, and results in over-polishing of the wafer.

Most CMP tools do not allow for direct optical inspection of the wafer's surface during the CMP processing, because the wafer is sandwiched between a chuck and the polishing pad. Polishing pads can be manufactured with an integrated optical waveguide to provide a path for indirect optical access. The CMP process can then be monitored by coupling light into this waveguide and measuring the light, reflected by the wafer, emitting from the waveguide. The chemical-mechanical-planarization tool control system may then be tailored to control the process based on the particular type of signal, optical or electronic, provided by the receiving device.

SUMMARY OF THE INVENTION

The present invention is a hub for use in an apparatus for electronic semiconductor wafer chemical-mechanical-planarization (CMP) table monitoring employing a waveguide embedded in the polishing pad. The apparatus includes a polishing pad and the hub. The polishing pad contains an imbedded waveguide with an outer lens fixture end and a light coupling center fixture end. The waveguide is arranged within the pad interior with the end fixtures embedded within a recess on the pad polishing surface such that the ends are located on the pad polishing surface. The waveguide is arranged entirely within the pad interior such that the outer lens end is at a location within the wafer track, and the light-coupling end is at the center of rotation of the polishing pad.

The hub contains a rotating portion, the vacuum attachment housing, in contact with the pad, and a stationary portion rotatably connected to the rotating portion in such a manner that the rotating portion positions the stationary portion in relation to the pad. Light may therefore be transmitted from the hub stationary portion to the moving waveguide coupling end and light may be transmitted from the moving waveguide coupling end to the hub stationary portion. The hub stationary portion includes an opto-electronic device to conduct light to and from the moving waveguide and a conductor to provide the electronic signal from the opto-electronic device to the stationary part of the CMP tool. Alternately it may transmit the signal through stationary lenses to an optical fiber. Signal processing circuitry may be located in the hub stationary portion, or may be located in the stationary part of the CMP tool. The stationary opto-electronic device or lenses are surrounded by a chamber that separates them from the rotating portion to which they are connected by bearings.

The hub contains stationary opto-electronic devices at the center of rotation of the CMP polishing pad, or alternately lenses and optical fiber. The rotating portion of the hub rotates with the pad during the CMP operation. The opto-electronic devices (or fiber) couple light into the waveguide. The opto-electronic devices convert any light emitting from the waveguide into an electrical signal. The hub also contains stationary electronic devices, which amplify this electrical signal and transmit it to remote analysis systems, and an encoder that provides a signal derived from the angular location of the polishing pad. Alternately, the hub contains these analysis systems in the form of microprocessors and/or data acquisition devices and circuitry, which digitize, store, and numerically process the electrical signals from the electronic devices. Alternately the optical signal is transmitted to analysis systems on the stationary part of the CMP table.

The hub is attached to the polishing pad by a vacuum that is provided through a vacuum hose located in the vacuum tube conduit and connected between the hub vacuum attachment housing and a vacuum supply on the stationary part of the CMP tool. The hub vacuum attachment housing that contacts the polishing pad surrounds the stationary opto-electronic device, or optical lenses, and associated electronic components, and contains a cavity between the rotating and stationary devices, called the vacuum chamber. This chamber is evacuated through a flow path to the vacuum hose. The hub vacuum attachment housing also contains a continuous groove in the contact surface with the pad. This equalizing groove surrounds the vacuum chamber that contains the opto-electronic device or lenses. This groove is connected to pressure equalizing flow passages through the vacuum attachment housing to provide a direct flow path to the vacuum tube conduit which is at ambient pressure outside of the vacuum hose. These passages provide the groove surrounding the vacuum chamber an ambient pressure approximately equal to the pressure at the surface of the pad. This groove provides a means to prevent slurry contaminates on the pad surface from leaking to the vacuum chamber as the pressures are equal, in other words there is no pressure differential, between the pad surface surrounding the hub and the equalizing groove that surrounds the vacuum chamber. The flow path for leakage between the hub and pad is from the relatively clean air in the portion of the vacuum tube conduit at ambient pressure to the continuous groove, through the leak path to the vacuum chamber and then to the vacuum hose. Leakage slurry contaminates on the pad surface outside the hub have no pressure differential between the hub exterior and the groove to establish leakage flow. No leakage will therefore occur between the hub exterior and the hub vacuum chamber.

Objects and Advantages

One object of the present invention is to provide a means of monitoring the CMP process using an optical sensor installed remote from the CMP process by coupling light into the integrated waveguide of the CMP polishing pad, and of measuring the light reflected back out of the waveguide, while allowing the CMP polishing pad to rotate freely about an axis.

A second object of the invention is to provide a means for determining the angular position of the polishing pad.

A third object of the invention is to provide a precisely aligned and easily attached means of coupling the light into and out of the waveguide.

A fourth object of the invention is to provide a means of monitoring the CMP process that is not degraded by polishing slurry contaminates.

REFERENCE NUMERALS IN DRAWINGS

Figure 1:
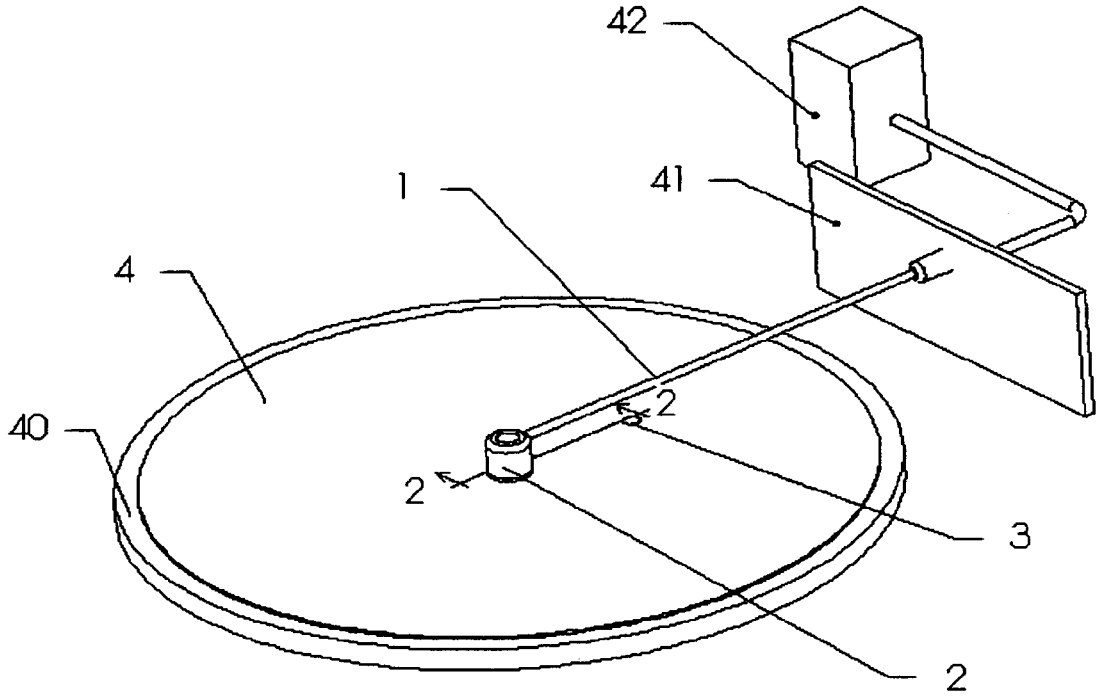
FIG. 1 is an isometric view of the present invention installed on a planarization table.

These reference numbers are used in the drawings to refer to areas or features of the invention.

| | |
|---|---|
| 1. | Vacuum Tube Conduit |
| 2. | Hub Cover |
| 3. | Outer Lens Fixture End on the Wafer Track |
| 4. | Polishing Pad |
| 6. | Hub Cover Access |
| 10. | Waveguide Optical Fiber |
| 11. | Waveguide Light Coupling Center Fixture End |
| 12. | Waveguide Light Coupling Center Fixture |
| 14. | Alignment Bearing |
| 15. | Printed Circuit Board |
| 16. | Micro-processing Device |
| 17. | Opto electronic Device |
| 18a. and 18b. | Bearing Pair |
| 19. | Flange |
| 20. | Cable |
| 22. | Polishing Pad Locator Assembly |
| 23. | First Polishing Pad Locating Dowel |
| 24. | Second Polishing Pad Locating Dowel |
| 25. | Rotating Encoder Disk |
| 26. | Optical Axis |
| 27. | Encoder Electronics |
| 28. | Seal |
| 29. | Positioning Keyway |
| 31. | Locator Groove |
| 33. | Locator Ridge |
| 40. | Polishing Table |
| 41. | CMP tool bulkhead |
| 42. | CMP tool control system |
| 43. | Vacuum Attachment Housing |
| 44. | Nut |
| 45. | Washer |
| 46. | Locating dowel |
| 47. | Vacuum supply hose |
| 48. | Vacuum Chamber |
| 49. | Pressure Equalizing Passage |

-continued

| | |
|---|---|
| 50. | Conduit optical fiber |
| 51. | Lens #1 |
| 52. | Lens #2 |
| 60. | Equalizing Groove |

DETAILED DESCRIPTION OF THE INVENTION

The present invention is an apparatus for delivering light to and receiving surface reflectance from a wafer undergoing CMP. It does so by embedding a fiber-optic wave-guide within the polishing pad. The wave-guide is a path containing optical fiber in the interior of the polishing pad having a penetration of the pad surface at the end of the optical fiber at the center of rotation and at a location on the pad where the wafer surface is located. These penetrations act together to guide light into the polishing pad at the waveguide light coupling transparent center fixture end, through its interior, and out of the pad at the waveguide outer lens fixture end; that is at a location within the wafer track. The wave-guide also guides light reflected by the wafer back into the polishing pad, through its interior, and out of the pad at its center of rotation.

The present invention is also an apparatus for coupling light into one end of the optical wave-guide located at the center of rotation of a polishing pad. It does so by locating a removable vacuum hub onto the pad and supplying vacuum to the hub to anchor it firmly and in close proximity to the optical wave-guide while allowing the pad to rotate freely. Removing the vacuum allows the hub to be removed from the pad for the purpose of replacing the polishing pad.

The present invention is also an apparatus and technique to allow for determining the exact angular position of the wafer edges with respect to the pad as the pad rotates. When the vacuum hub is secured to the pad, it forms the rotating member of an angular position encoder, while the electronics attached to the stationary hub portion forms the stationary member of the encoder. The angular encoder signals are used to "home the pad," in other words, locate the pad and its direction with respect to the semiconductor wafer(s). The technique involves loading the spindle with a wafer and placing it in contact with the rotating polishing pad. By simultaneously tracking the encoder counts and monitoring the reflectance signal for abrupt changes, the wafer's leading and trailing edges can be detected and the corresponding encoder counts saved to memory. The saved encoder count values can then be used to resolve the location of the waveguide outer lens fixture and trigger optical analysis at any point along the surface of the wafer as the fixture containing the optical fiber sweeps beneath it.

The present invention is also an apparatus for locating the polishing pad onto the polishing table by providing locating pins on the table and corresponding locating holes in the polishing pad containing the waveguide light coupling center fixture.

The present invention is also an apparatus for precisely locating the optical sensor contained within the optical coupler hub assembly over the waveguide optical fiber within the waveguide light coupling center fixture by providing a groove on the waveguide light coupling center fixture and a mating ridge on the positioning keyway.

The present invention also contains a provision for directing potential harmful contaminates in the polishing slurry away from the polishing table components that monitor the CMP process.

FIG. 1 shows an isometric view of the invention consisting of a vacuum tube conduit (1) connected to the hub stationary portion (2) located at the center of rotation of a circular polishing pad (4). An optical waveguide containing an optical fiber is imbedded into the pad interior from near the center of the wafer track (3) to the center of rotation of the waveguide center fixture, located under the hub (2). The end of the vacuum tube conduit opposite the stationary hub portion will normally be attached to a stationary bulkhead (41) of the CMP tool. FIG. 1 also shows the polishing table (40) and the electrical connection to the stationary CMP tool control system (42).

Figure 2:
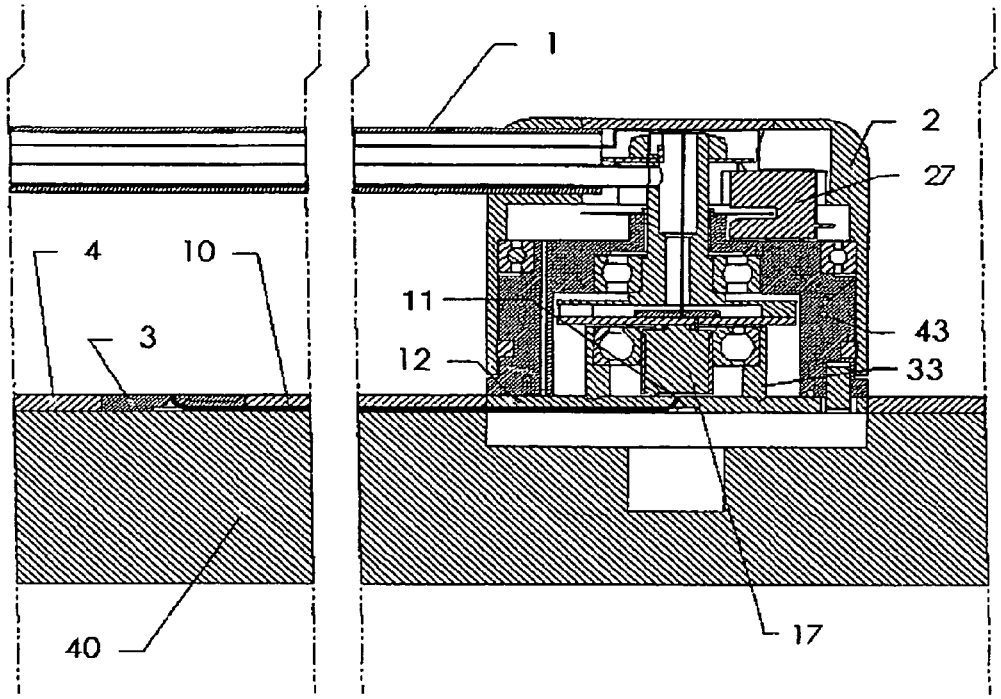
FIG. 2 is a cross-sectional view of the invention at the location shown in FIG. 1.

FIG. 2 depicts a close-up cross section of the invention. The vacuum tube conduit (1) is connected to the stationary portion of the hub that consists of the hub cover (2), the opto-electronic device (17), its associated electronics, and its supporting structure, and the encoder electronics (27). The polishing pad (4) on the polishing table (40) contains the waveguide optical fiber (10) contained within the polishing pad waveguide passage. The waveguide has a light coupling center fixture (12) end located at the center of rotation, under the opto-electronic device (17), which is stationary, and an outer lens end (3) located near the center of the wafer track. The waveguide light coupling center fixture end (11) and outer lens end (3) are located within recesses in the pad surface that are sized to place the exposed surfaces even with the polishing surface of the pad. The rotating portions of the hub are the locator ridge sleeve (33) and the vacuum attachment housing (43).

Figure 3:
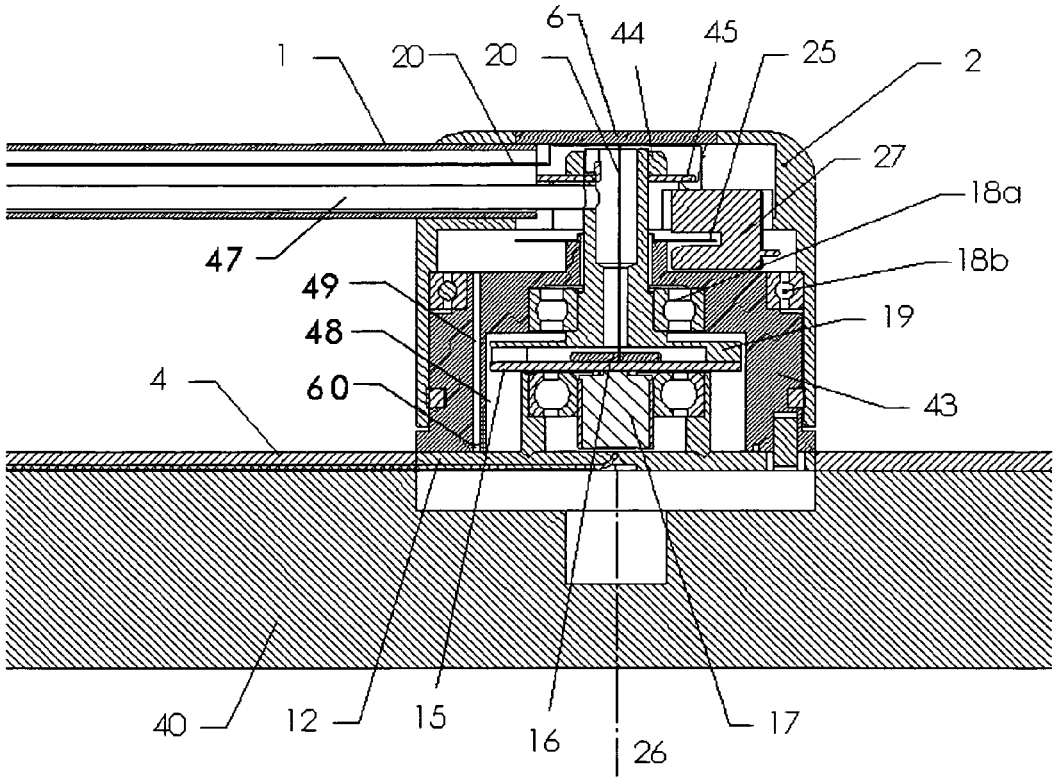
FIG. 3 is an expanded cross-sectional view of the hub at the same cross-section as FIG. 2.

FIG. 3 shows a cross-sectional drawing of the optical coupler hub assembly showing the polishing pad (4) mounted on the polishing table (40), the stationary hub cover (2), connected by the vacuum tube housing (1) to the stationary portion of the CMP tool shown in FIG. 1, and the hub rotating vacuum attachment housing (43). When the vacuum attachment housing (43) is located onto the polishing pad (4) precisely over the center of rotation, the optical axis (26) of the waveguide light coupling center fixture (12) is on this center; then bearing pair (18*a* & 18*b*) allows the hub rotating portion, that is the vacuum attachment housing (43) and the attached encoder disk (25), to rotate about the optical axis (26) while the hub stationary portions do not rotate. The stationary hub cover (2) is attached to the stationary encoder electronics (27) which may be used to "home the pad" as previously described. The stationary opto-electronic device (17), micro-processing device (16), and printed circuit board (15) are attached to a stationary structure consisting of the flange (19), which has a shaft extending up and through an opening in the vacuum attachment housing and is secured to the stationary hub cover (2) by nut (44) and washer (45). The stationary hub cover has a removable access plug (6) for assembly and disassembly of the nut and washer. The hub cover (2) is attached to the vacuum tube conduit (I) to form the stationary external portion of the hub.

The printed circuit board (15) supports the micro-processing device (16) that amplifies the electrical signal from the opto-electronic device and then transmits it on the cable (20) to stationary analysis systems in the CMP tool control system, item 42 in FIG. 1.

In the preferred embodiment of the invention, the printed circuit board contains a micro-processing device also capable of analyzing the electrical signal from the opto-electronic device and then transmitting a signal indicative of the state of the polishing process of the wafer surface to the CMP tool control system.

The bearing pair (18*a* & 18*b*) allows the vacuum attachment housing (43) to rotate about stationary portion components (1), (19), (15), (16), (17), (2) and (27), while positioning opto-electronic device (17) in such a way as to couple light into and receive light from the waveguide center fixture (12) allowing it to convert light emitting from the waveguide into a usable electrical signal. The electrical signal is transmitted on cable (20) from the printed circuit board to the vacuum tube conduit (1) and connecting to the stationary CMP tool control system.

The hub is attached to the polishing pad by vacuum that is provided through a vacuum hose (47) located in the vacuum tube conduit (1) connected between the hub stationary portion and a vacuum supply on the stationary part of the CMP tool. The hub vacuum attachment housing (43) that contacts the polishing pad surrounds the stationary opto-electronic device (17), and associated electronic components (15, 16), and contains a cavity between the rotating and stationary devices, called the vacuum chamber (48). This cavity, or chamber, is evacuated through a flow path to the vacuumhose. The hub vacuum attachment housing also contains a continuous groove (60) in the contact surface with the pad. This equalizing groove (60) surrounds the vacuum chamber (48) that contains the opto-electronic device. This groove is connected to one or more pressure equalizing passages (49) through the vacuum attachment housing to provide a flow path to the portion of the vacuum conduit at ambient pressure. The flow path for leakage between the hub and pad is from the relatively clean air in the portion of the vacuum tube conduit at ambient pressure through the equalizing passages (49) to the continuous groove, through the leak path to the vacuum chamber (48) and then to the vacuum hose (47). No leakage will therefore occur between the hub exterior and the hub vacuum chamber. This groove provides a means to prevent slurry contaminates on the pad surface from leaking to the vacuum chamber as the pressures are equal, in other words there is no pressure differential, between the pad surface surrounding the hub and the equalizing groove that surrounds the vacuum chamber.

Figure 4:
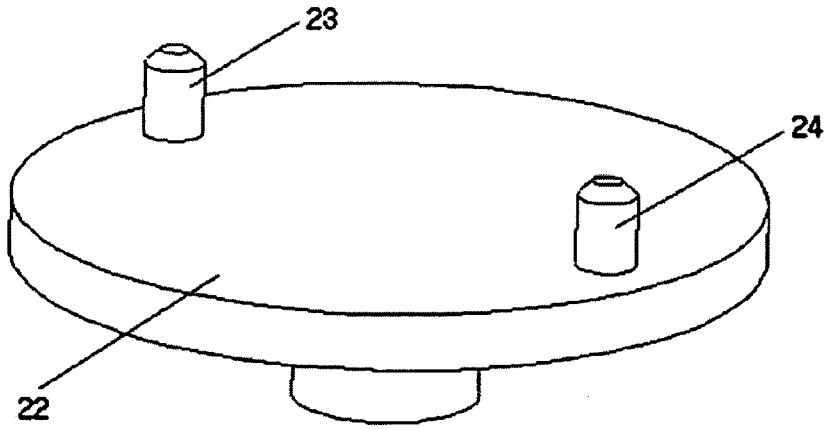
FIG. 4 is an isometric view of an embodiment of the present invention in which locating dowels are mounted on a locating plate.

FIG. 4 shows a perspective view of the polishing pad locator assembly (22) and the two polishing pad locating dowels (23) & (24). Alternately, the locator dowels may be installed directly into the polishing table, if the polishing table cannot accommodate the polishing pad locator plate.

Figure 5:
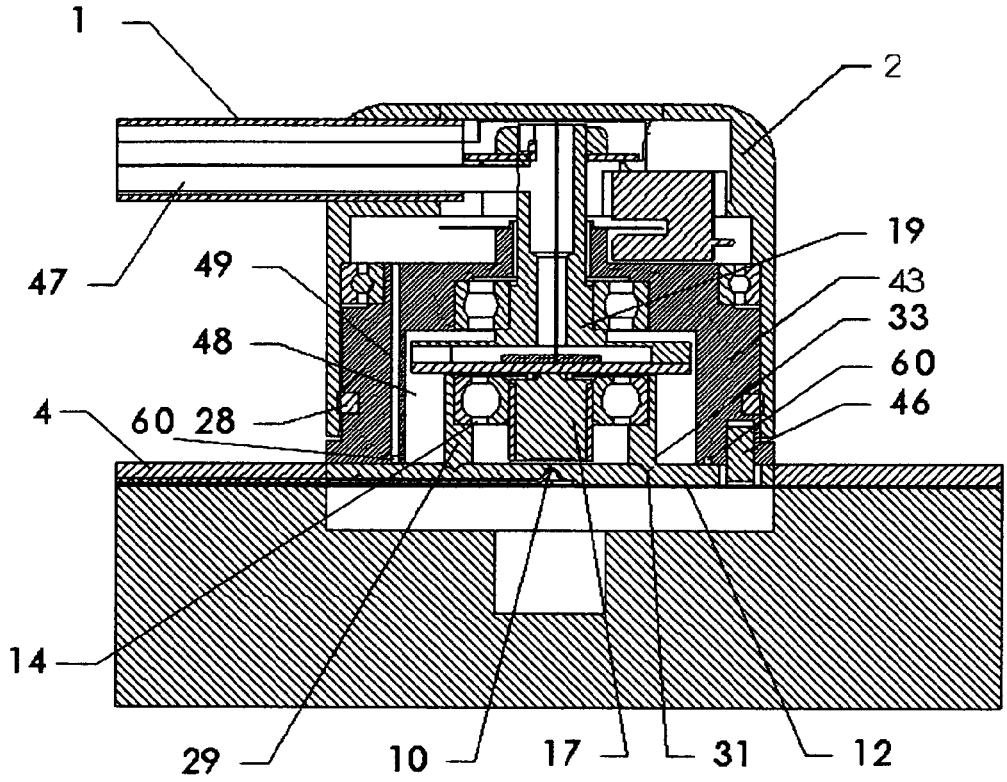
FIG. 5 is a cross-sectional view of the hub at the same cross-section as FIG. 2. This view is similar to FIG. 3 but, for clarity, contains reference numbers not shown in FIG. 3.

FIG. 5 shows a cross-sectional side view of the hub with the waveguide center fixture (12) showing the rotating locator groove (31) in the center fixture, which mates with a corresponding rotating locator ridge (33) on the rotating positioning keyway (29) lower surface to precisely align the opto-electronic device (17), which is mounted on the stationary flange (19), with the rotating waveguide optical fiber end (10) in the center fixture (12). The groove may be the only positioning means, or may be used in conjunction with the locating dowels (46) as shown in FIG. 5. Alignment bearing (14) allows the opto-electronic positioning keyway (29) to rotate about the opto-electronic device (17) when the optical coupler hub assembly is attached to the polishing pad.

FIG. 5 also shows the vacuum supply hose (47) inside of the vacuum tube conduit (1). Vacuum is maintained in the vacuum chamber (48) by the vacuum hose (47). The vacuum propagates through the flange and into the vacuum chamber (48). Atmospheric pressure on the hub cover (2) exceeds the vacuum pressure in the vacuum chamber, providing a force to hold the hub on the polishing pad surface (4). There would be a potential for leakage between the pad surface external to the hub and the vacuum chamber if it weren't for the equalizing groove (60) and the pressure equalizing passages (49). The equalizing groove surrounds the vacuum chamber and is essentially at the same atmospheric pressure as the pad surface. There is no pressure differential between the pad surface and the equalizing groove to drive a leakage flow. Instead if leakage occurs it will be from the relatively clean air in the vacuum tube conduit (1) surrounding the vacuum hose (47). The flow would be from the conduit (1) through the pressure equalizing passages (49) to the equalizing groove (60), located between the vacuum chamber (48) and the vacuum attachment housing (43) edge. The flow then would be through the leakage path to the vacuum chamber and then through the chamber to the vacuum hose (47). Thus the equalizing groove precludes polishing fluid from the pad surface from flowing through the vacuum chamber where it may damage the optoelectronic device and associated electronics. This groove provides a means to prevent slurry contaminates on the pad surface from leaking to the vacuum chamber as the pressures are equal, in other words there is no pressure differential, between the pad surface surrounding the hub and the equalizing groove that surrounds the vacuum chamber.

Also shown in FIG. 5, seal (28) prevents air leakage causing material to enter into the gap between the stationary hub cover (2) and the rotating vacuum attachment housing (43). The seal also prevents material from exiting the gap, thereby preventing the hub from becoming a particle generator.

Alternate Embodiments

Figure 6:
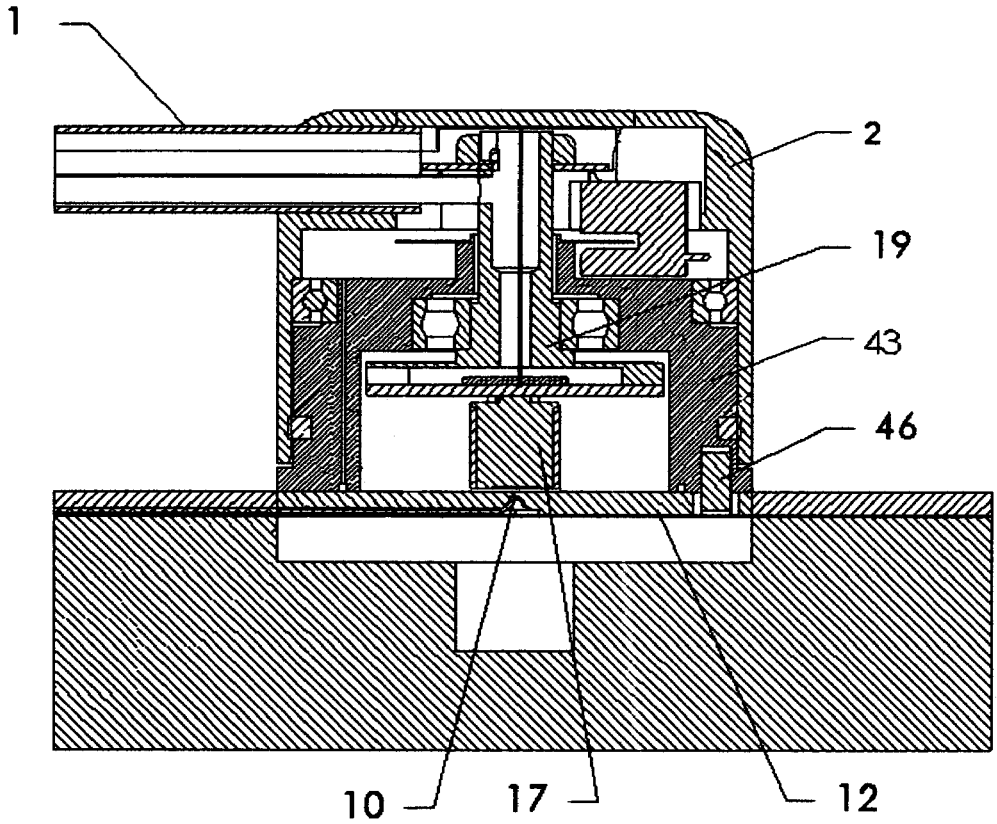
FIG. 6 is a cross-sectional view of the hub at the same cross-section as FIG. 2. This view shows an embodiment that uses locating dowels to align the hub.

FIG. 6 shows a cross-sectional view of an embodiment of the optical coupler hub assembly similar to that in FIG. 5, however in this embodiment the locator dowels (46) are the only alignment means. The positioning of the stationary vacuum tube (1), hub cover (2), opto-electronic device (17) and associated electronics, its supporting flange (19), and the rotating vacuum attachment housing (43) in relation to the optical fiber (10) in the waveguide center fixture (12) is determined by the locator dowels (46).

Figure 7:
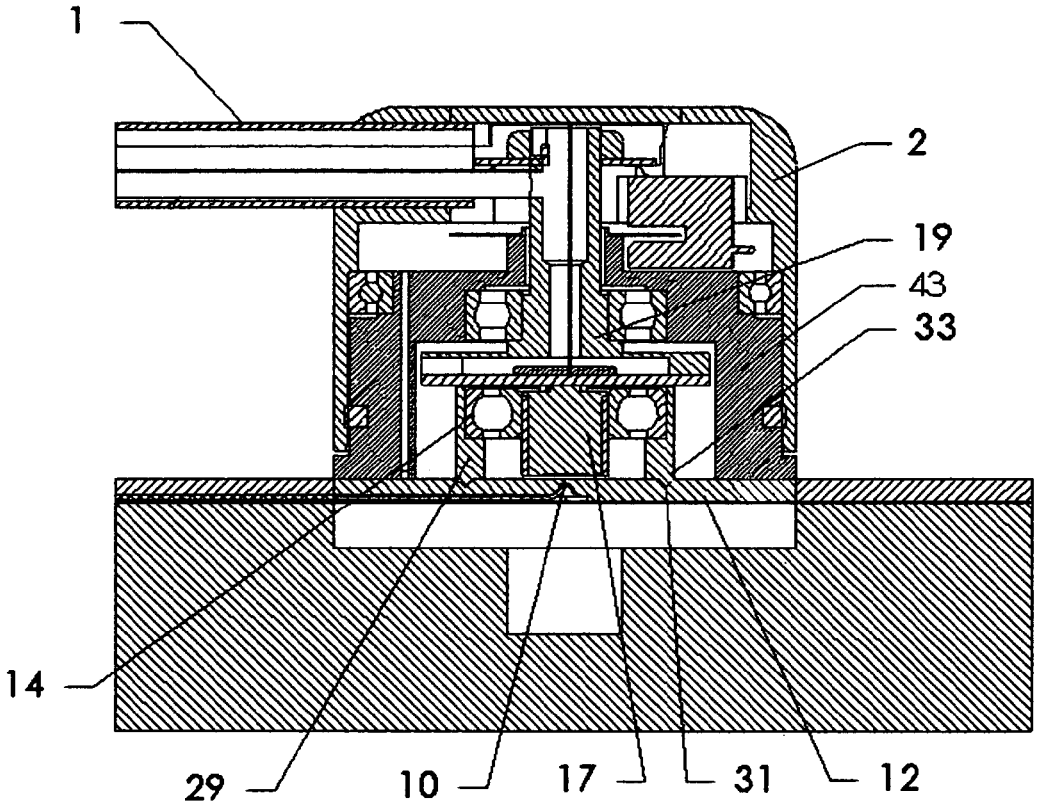
FIG. 7 is a cross-sectional view of the hub at the same cross-section as FIG. 2. This view shows an embodiment that uses a locater groove and ridge to align the hub.

FIG. 7 shows a cross-sectional view of another embodiment of the optical coupler hub assembly in which the rotating locator groove (31) in the center fixture, which mates with a corresponding rotating locator ridge (33) on the rotating positioning keyway (29) as the only alignment means. The positioning of the stationary vacuum tube (1), hub cover (2), opto-electronic device (17), its supporting flange (19), and the rotating vacuum attachment housing (43) in relation to the optical fiber (10) in the waveguide center fixture (12) is determined by the locator groove (31) in the waveguide center fixture (12) mating with the locator ridge (33) on the positioning keyway (29). The positioning keyway rotates around the stationary flange (19) on the alignment bearing (14).

Figure 8:
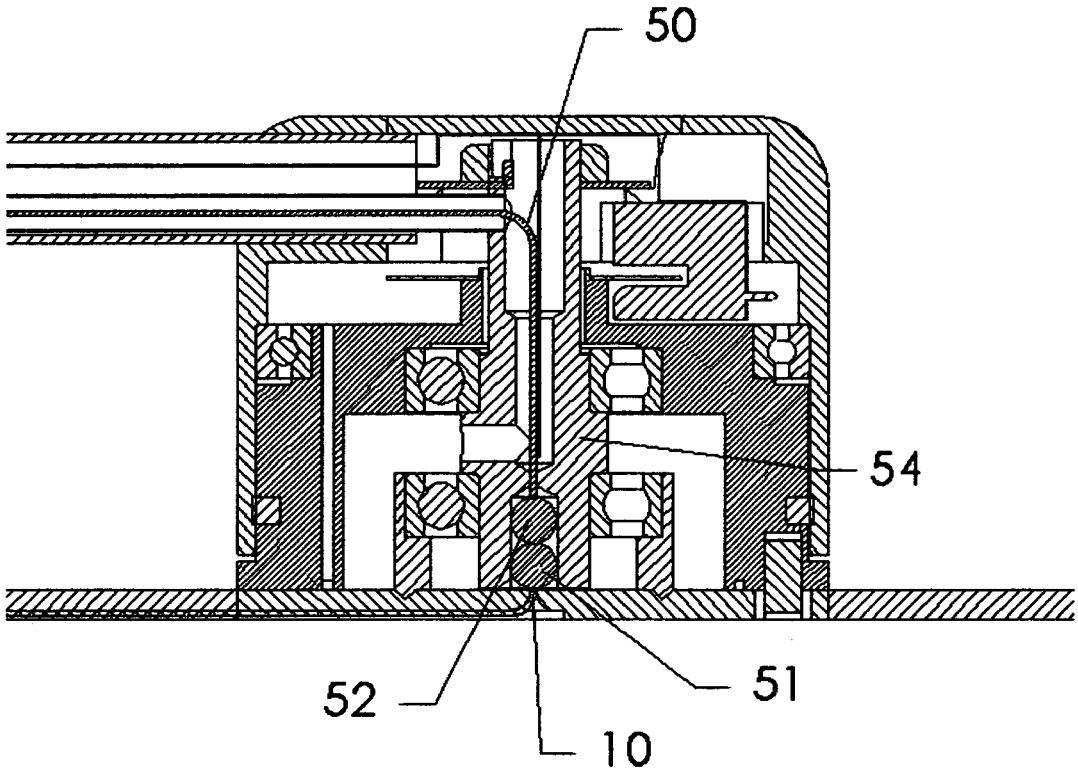
FIG. 8 is a cross-sectional view of an embodiment of the hub at the same cross-section as FIG. 2. This view shows a light from an optical fiber focused into the waveguide optical fiber, and the returning optical signal from the waveguide optical fiber focused back into the optical fiber by a pair of stationary lenses.

FIG. 8 shows a cross-sectional view of another embodiment of the optical coupler hub assembly. In this embodiment the optical signal from the waveguide optical fiber (10) is focused into conduit optical fiber (50) by a pair of stationary lenses (51 & 52) housed within a stationary optical fiber support shaft (54). The optical signal is then transmitted to the CMP tool control system, item 42 in FIG. 1, where the signal is analyzed.

I claim:

1. An apparatus for electronic wafer chemical-mechanical-planarization table process monitoring comprising:

a. a polishing pad and a hub;

b. the polishing pad having a polishing surface and an attachment surface and an embedded waveguide with an outer lens fixture end with a means for delivering light and a light coupling center fixture end;

c. the waveguide is arranged within the pad interior such that the waveguide light coupling center fixture end and outer lens fixture end is embedded within a recess on the pad polishing surface such that the ends are located on the pad polishing surface;

d. the waveguide is arranged within the pad interior such that the waveguide light coupling center fixture end is at the center of rotation of the polishing pad and the outer lens fixture end is at a location within the wafer track;

e. the hub contains a rotating portion and a stationary portion rotatably connected and arranged such that the rotating portion positions the stationary portion wherein light may be transmitted from the hub stationary portion to the waveguide light coupling center fixture end and light may be transmitted from the waveguide light coupling center fixture end to the hub stationary portion wherein when the waveguide is opposite a wafer contacting the surface of the polishing pad, the hub stationary portion provides light to and receives surface reflectance from the wafer;

f. the stationary portion contains an opto-electronic device positioned in proximity to the table polishing pad waveguide entrance wherein the opto-electronic device contains a light source to provide the light transmitted from the hub stationary portion, and wherein the opto-electronic device receives the light transmitted from the waveguide light coupling center fixture end; and g. the opto-electronic device contains means for converting the received light into an electrical signal derived from the light, and transmitting the amplified, processed electronic signal on a conductor.

2. The apparatus for electronic wafer chemical-mechanical-planarization table process monitoring as in claim 1 further comprising the hub contains an angular position encoder arranged with means for conducting electronic signals to and from the hub stationary portion to a stationary portion of the table.

3. The apparatus for electronic wafer chemical-mechanical-planarization table process monitoring as in claim 2 further comprising the hub contains means for analysis of the electronic signals wherein the state of the electronic wafer polishing may be derived from the electronic signal derived from the light and wherein the polishing pad direction, angle, and speed may be derived from the electronic signal from the angular position encoder.

4. The apparatus for electronic wafer chemical-mechanical-planarization table process monitoring as in claim 3 further comprising the hub is attached to the polishing pad by vacuum.

5. The apparatus for electronic wafer chemical-mechanical-planarization table process monitoring as in claim 4 further comprising the hub is positioned on the polishing pad by a plurality of locating dowels and corresponding locating holes in the polishing pad and hub.

6. The apparatus for electronic wafer chemical-mechanical-planarization table process monitoring as in claim 4 further comprising the hub is positioned on the polishing pad by a locator ridge on the opto-electronic device lower surface and a corresponding locator groove in the polishing pad light coupling center fixture.

7. The apparatus for electronic wafer chemical-mechanical-planarization table process monitoring as in claim 4 further comprising the hub is positioned on the polishing pad by a locator ridge on the opto-electronic device lower surface and a corresponding locator groove in the polishing pad light coupling center fixture and by a plurality of locating dowels and corresponding locating holes in the polishing pad and hub.

8. The apparatus for electronic wafer chemical-mechanical-planarization table process monitoring as in claim 4 further comprising the hub rotating portion is arranged with means for preventing leakage of slurry contaminates between the hub rotating portion and the polishing pad.

9. An apparatus for electronic wafer chemical-mechanical-planarization table process monitoring comprising:

a. a polishing pad and a hub;

b. the polishing pad having a polishing surface and an attachment surface and an embedded waveguide with an outer lens fixture end with a means for delivering light and a light coupling center fixture end;

c. the waveguide is arranged within the pad interior such that the light coupling center fixture end and outer lens fixture end is embedded within a recess on the pad polishing surface such that the ends are located on the pad polishing surface;

d. the waveguide is arranged within the pad interior such that the light coupling center fixture end is at the center of rotation of the polishing pad and the outer lens fixture end is at a location within the wafer track;

e. the hub contains a rotating portion and a stationary portion rotatably connected and arranged such that the rotating portion positions the stationary portion wherein light may be transmitted from the hub stationary portion to the waveguide light coupling center fixture end and light may be transmitted from the waveguide light coupling center fixture end to the hub stationary portion wherein when the waveguide is opposite a wafer contacting the surface of the polishing pad, the hub stationary portion provides light to and receives surface reflectance from the wafer;

f. the stationary portion contains means for transmitting the light received from the waveguide light coupling center fixture end to a stationary portion of the table; and g. the hub is positioned on the polishing pad by a locator ridge on the positioning keyway and a corresponding locator groove in the polishing pad light coupling center fixture.

10. The apparatus for electronic wafer chemical-mechanical-planarization table process monitoring as in claim 9 further comprising the hub is positioned on the polishing pad by a locator ridge on the optoelectronic device lower surface and a corresponding locator groove in the polishing pad light coupling center fixture and by a plurality of locating dowels and corresponding locating holes in the polishing pad and hub.

11. The apparatus for electronic wafer chemical-mechanical-planarization table process monitoring as in claim 9 further comprising the hub rotating portion is removably attached to the polishing pad by vacuum, the hub rotating portion arranged with means for preventing leakage of slurry contaminates between the hub rotating portion and the polishing pad.

12. An optical signal delivery and retrieval system to measure wafer surface reflectivity on a rotating planarization table comprising:

a means for providing light to the surface of a rotating wafer polishing pad;

b. means for receiving reflected light from the wafer surface in contact with the rotating pad surface;

c. means for conducting the light providing means and light receiving means through the center of rotation of the polishing pad;

d. means for converting the received light to an electronic signal; and e. means for conducting the electronic signal to a chemical-mechanical-planarization tool control system.

13. An optical signal delivery and retrieval system to measure wafer surface reflectivity on a rotating planarization table as in claim 12 further comprising means for analyzing the electronic signal, and means for conducting the analyzed electronic signal to a chemical-mechanical-planarization tool control system.

14. An optical signal delivery and retrieval system to measure wafer surface reflectivity on a rotating planarization table as in claim 12 further comprising means for sensing the position of the polishing pad surface light providing means and light receiving means.

15. An optical signal delivery and retrieval system to measure wafer surface reflectivity on a rotating planarization table as in claim 12 further comprising means for preventing leakage of slurry contaminates between the hub rotating portion and the polishing pad.

16. An optical signal delivery and retrieval system to measure wafer surface reflectivity on a rotating planarization table as in claim 13 further comprising means for sensing the position of the polishing pad surface light providing means and light receiving means.

17. An optical signal delivery and retrieval system to measure wafer surface reflectivity on a rotating planarization table as in claim 13 further comprising means for preventing leakage of slurry contaminates between the hub rotating portion and the polishing pad.

18. An optical signal delivery and retrieval system to measure wafer surface reflectivity on a rotating planarization table comprising:

a. means for providing light to the surface of a rotating wafer polishing pad;

b. means for receiving reflected light from the wafer surface in contact with the rotating pad surface;

c. means for conducting the light providing means and light receiving means through the center of rotation of the polishing pad;

d. means for conducting the received light signal to a chemical-mechanical-planarization tool control system;

e. means for sensing the position of the wafer surface in relation to the means for providing and receiving light at the polishing pad surface; and f. means for preventing leakage of slurry contaminates between the means for providing light to the surface of a rotating wafer polishing pad and the polishing pad.

* * * * *